US005400040A

United States Patent [19]

Lane et al.

[11] Patent Number: 5,400,040

[45] Date of Patent: Mar. 21, 1995

[54] MICROSTRIP PATCH ANTENNA

[75] Inventors: Jeffrey P. Lane, Haverhill; Joseph P. Biondi, N. Andover, both of Mass.; Joseph S. Pleva, Londonderry, N.H.

[73] Assignee: Raytheon Company, Lexington, Mass.

[21] Appl. No.: 54,377

[22] Filed: Apr. 28, 1993

[51] Int. Cl.[6] ..... H01Q 1/38

[52] U.S. Cl. ..... 343/700 MS; 343/822; 343/873

[58] Field of Search ..... 343/822, 846, 873, 700 MS; H01Q 1/38

[56] References Cited

U.S. PATENT DOCUMENTS

| | | | |
|---|---|---|---|
| 3,947,850 | 3/1976 | Kaloi | 343/822 X |
| 4,072,951 | 2/1978 | Kaloi | 343/846 X |
| 4,686,535 | 9/1987 | Lalezari | 343/700 MS X |
| 4,816,836 | 3/1989 | Lalezari | 343/873 X |
| 4,893,129 | 1/1990 | Kodera et al. | 343/700 MS |
| 4,907,006 | 3/1990 | Nishikawa et al. | 343/700 MS X |
| 4,924,236 | 5/1990 | Schuss et al. | 343/700 MS |
| 5,008,681 | 4/1991 | Cavallaro et al. | 343/700 MS |
| 5,231,407 | 7/1993 | McGirr et al. | 343/700 MS X |
| 5,337,066 | 8/1994 | Hirata et al. | 343/700 MS X |

OTHER PUBLICATIONS

"Nonradiating Edges and Four Edges Gap-Coupled Multiple Resonator Broad-Band Microstrip Antennas," G. Kumer, et al., IEEE Transactions on Antennas and Propagation, vol. AP-33, No. 2, pp. 173-178, Feb. 1985.

*Primary Examiner*—Donald Hajec
*Assistant Examiner*—Steven Wigmore
*Attorney, Agent, or Firm*—Donald F. Mofford

[57] ABSTRACT

A patch radiator antenna is described including a sheet of conductive material and a dielectric substrate having a first and second surface, the sheet of conductive material disposed upon the first surface of the dielectric substrate. The patch radiator antenna further includes a plurality of patch radiator elements disposed upon the second surface of the dielectric substrate, each one of the plurality of patch radiator elements having sides with a width and a length. The plurality of patch radiator elements include a first patch radiator element having a feed probe to couple the first patch radiator element to an RF signal source and at least one second patch radiator element including a microstrip feed along the width of the patch radiator element, the at least one second patch radiator element disposed fore of the first patch radiator element. The patch radiator antenna further includes a strip conductor having a first end and a second end, the first end connected to the microstrip feed and the second end connected along the length of the first patch radiator element. With such an arrangement, a corporate feed for each patch radiator element is eliminated, thus reducing feed line radiation.

16 Claims, 6 Drawing Sheets

MICROSTRIP PATCH ANTENNA

This invention was made with Government support under Contract No. DAAH01-91-C-A017 awarded by the Department of the Army. The Government has certain rights in this invention.

BACKGROUND OF THE INVENTION

This invention relates to patch antennas and more particularly to directional patch antennas wherein multiple patch radiators are used to control the direction of a beam of radio frequency (RF) energy from the antenna.

In missile applications, antennas are often required to be mounted conformally with the generally cylindrical shape of a missile. Antennas which adapt easily to conformal mounting usually produce a beam of RF energy having a main lobe directed normally (or broadside to) the missile. In some applications, the required direction of the main lobe of the beam of RF energy is in a direction along an axis of the missile. To provide the latter, known patch antennas either include elements which are parasitically fed or corporate feeds to provide the RF energy to each patch element. A corporate feed includes components that occupy critical area internal to the missile. The mass and volume of all components within the missile are critical to the performance of the missile and any decrease in the size and number of components is highly desirable.

SUMMARY OF THE INVENTION

With the foregoing background in mind, it is an object of this invention to provide a patch antenna easily mounted on a side of a missile while providing a beam of RF energy having a main lobe along the axis of the missile.

Another object of this invention is to provide a patch antenna with less components.

The foregoing and other objects of this inventions are met generally by a patch radiator antenna including a sheet of conductive material and a dielectric substrate having a first and second surface, the sheet of conductive material disposed upon the first surface of the dielectric substrate. The patch radiator antenna further includes a plurality of patch radiator elements disposed upon the second surface of the dielectric substrate, each one of the plurality of patch radiator elements having sides with a width and a length. The plurality of patch radiator elements include a first patch radiator element having a feed probe to couple the first patch radiator element to an RF signal source and at least one second patch radiator element including a microstrip feed along the width of the patch radiator element, the at least one second patch radiator element disposed fore of the first patch radiator element. The patch radiator antenna further includes a strip conductor having a first end and a second end, the first end connected to the microstrip feed and the second end connected along the length of the first patch radiator element. With such an arrangement, a corporate feed for each patch radiator element is eliminated, thus reducing feed line radiation.

In accordance with another aspect of the present invention, a patch radiator antenna includes a first patch radiator having a pair of edges and a technique for providing an image patch radiator element in front of the first patch radiator for providing a desired end fire excitation. The technique includes a second patch radiator having a microstrip feed, the second patch radiator disposed fore of the first patch radiator and a third patch radiator having a microstrip feed, the third patch radiator also disposed fore of the first patch radiator. The technique includes coupling a portion of RF energy propagating therethrough between the first patch radiator and the second patch radiator and between the first patch radiator and the third patch radiator including a first strip conductor having a first end and a second end, the first end connected to the first patch radiator along one of the edges and the second end connected to the microstrip feed of the second patch radiator and a second strip conductor having a first end and a second end, the first end connected to the first patch radiator along a different one of the edges and the second end connected to the microstrip feed of the third patch radiator. With such an arrangement, an apparent image patch is provided to simulate a two element linear array to provide the desired end fire directivity. When using two patch radiator elements disposed juxtapositional with each other to provide a linear array, such an arrangement produced excessive mutual coupling which inhibited the required directivity. The above described arrangement provides the required directivity by reducing mutual coupling among adjacent patch radiator elements and with less feed lines required, reduces feed line radiation.

BRIEF DESCRIPTION OF THE DRAWING

For a more complete understanding of this invention, reference is now made to the following description of the accompanying drawings, wherein.

DESCRIPTION OF THE PREFERRED EMBODIMENTS

Figure 1:
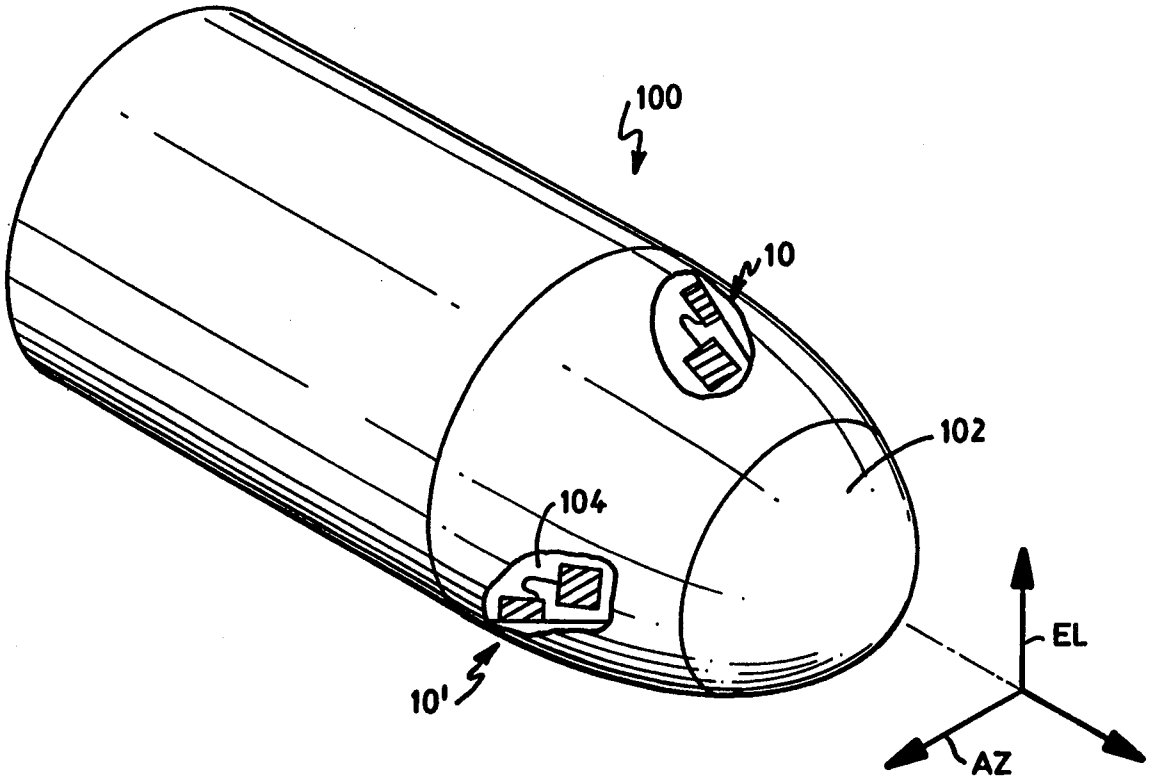
FIG. 1 is a sketch of an fore portion of a missile showing the contemplated location of a patch radiator antenna according to the invention.

Referring now to FIG. 1, it may be seen that a missile 100 includes a fore portion (not numbered) wherein an infrared (IR) dome 102 is mounted. The IR dome 102 protects electronics (not shown) mounted behind the IR dome 102 while providing an aerodynamically enhanced shape to the missile 100. Also provided behind the IR dome 102 is a truncated conic ring 104 located aft of the IR dome 102 with a patch radiator antenna 10, here a transmit antenna at C-band, and a patch radiator antenna 10', here a receive antenna at C-band, disposed about the truncated conic ring 104. As described further hereinafter, the patch radiator antenna 10 and 10' are arranged to provide a forward looking beam for radio frequency (RF) energy in the direction forward of the missile 100. In the present application, the patch radiator antenna 10 and 10' are part of an altimeter system wherein using radar doppler techniques, as the missile descends toward the ground, the height of the missile 100 is determined. It should be appreciated that the patch radiator antenna 10 and the patch radiator antenna 10' are similar in construction and the following description for the patch radiator antenna 10 is also applicable for the patch radiator antenna 10'. The patch radiator antenna 10 and the patch radiator antenna 10' provides a directional beam in a small circuit area and by disposing each antenna on opposite sides of the truncated cone 104, a nearly symmetric two way forward looking beam of RF energy is achieved.

Figure 2:
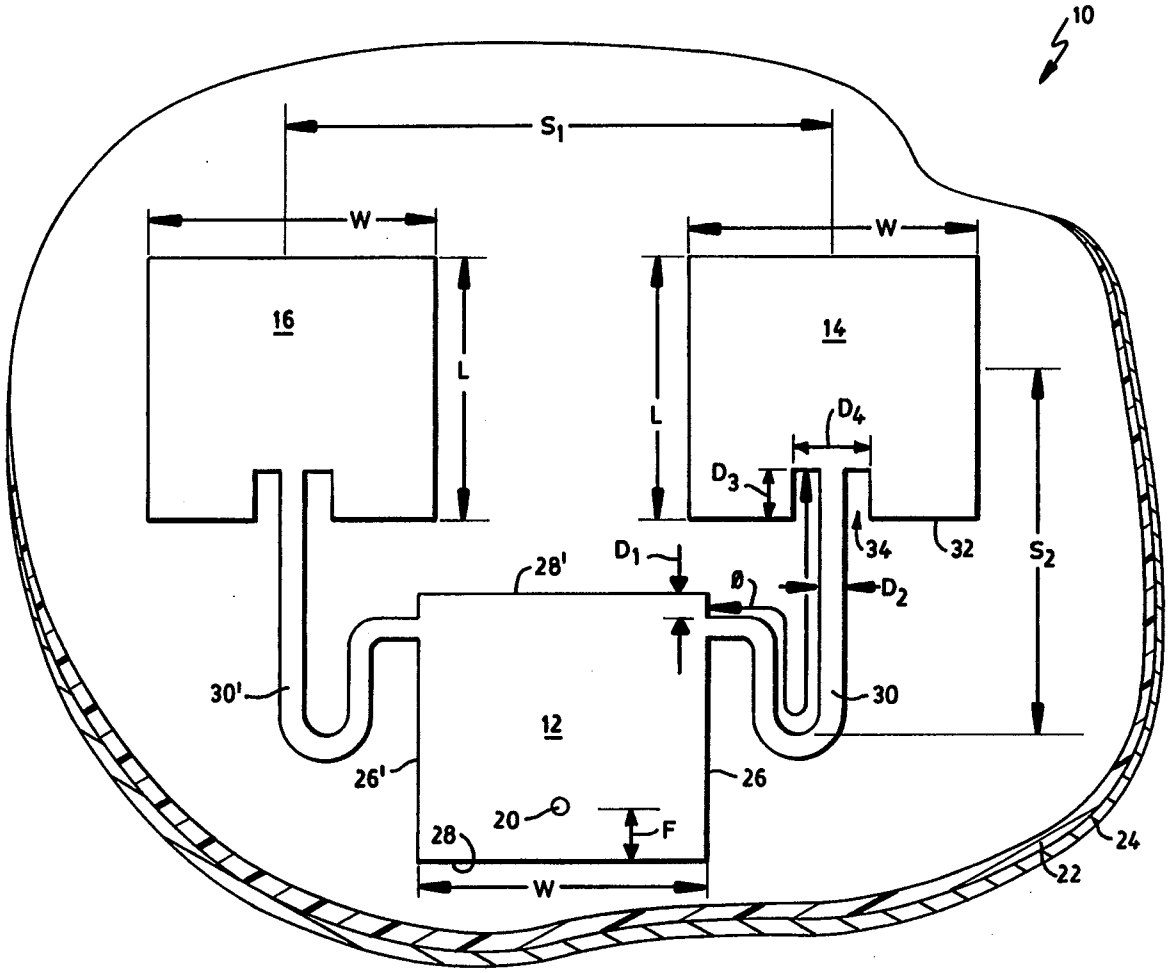
FIG. 2 is a plan view of the patch radiator antenna according to the invention.

Referring now to FIG. 2, the patch radiator antenna 10 as here contemplated is shown to include a plurality of patch radiator elements 12, 14 and 16 disposed on a dielectric substrate 22. The patch radiator elements 12, 14, and 16 are formed by depositing an electrically conducting material (here copper) in any conventional manner as shown. The patch radiator element (herein also referred to as a patch) 12 when actuated by itself, is operative to form a beamby reason of fringing fields around the periphery of such patch and the main lobe of such beam is broadside to such patch. Further, it will be observed that the patch 12, when matched to a feed, here coaxial line 20, is effectively equivalent to a resonant cavity. The coaxial line 20 in electrical contact with the patch 12 is passed through a dielectric substrate 22 and connected to a coaxial transmission line which couples RF energy (i.e. an RF signal) to requisite electronic circuitry (not shown). The outer shield of the coaxial transmission line is connected to a conductive sheet (i.e. ground plane) 24. It should be appreciated that the location of the connection of the coaxial line 20 does not affect the frequency of resonance, but the location does affect the input impedance of the patch radiator antenna 10 being described.

It should be appreciated that a patch has a constant impedance along the width W of the patch, but a changing impedance along the length L of the patch. Along an edge 26 having a length L of the patch 12, at the center of the edge 26, a low impedance exists with the impedance increasing when approaching an edge 28 or an edge 28'. The location of a connection point along the length of the patch 12 controls the resulting impedance of the connection point. Thus, the distance F being the distance from the edge 28 of the patch 12 to the center of the connection of the coaxial line 20 controls the input impedance of patch radiator antenna 10. In the present application, the distance F is approximately 0.0188 wavelengths of the RF energy propagating therethrough.

The patch radiator elements 12, 14 and 16 each have a length L here of approximately 0.2916 wavelengths of the RF energy propagating therethrough and a width W of approximately 0.3174 wavelengths of the RF energy propagating therethrough. The patch radiator antenna 10 further includes a strip conductor 30 having a first end connected to the patch 12 and a second end connected to the patch 14. The strip conductor 30 has a width $D_2$, here approximately 0.0071 wavelengths of the RF energy propagating therethrough and a length $\phi$, here approximately 0.6843 wavelengths of the RF energy propagating therethrough. The first end of the strip conductor 30 is connected along the edge 26 a distance $D_1$, here approximately 0.0188 wavelengths of the RF energy propagating therethrough, from a corner of the patch 12. The latter controls the impedance of the connection point as described hereinbefore and is selected to match the impedance of the strip conductor 30.

The patch 14 and the patch 16 are disposed fore of the patch 12 a distance $S_2$, here approximately 0.3231 wavelengths of the RF energy propagating therethrough, as shown. The patch 14 and the patch 16 are disposed with a center to center spacing $S_1$, here approximately 0.8231 wavelengths of the RF energy propagating therethrough, as shown. The second end of the strip conductor 30 is connected to the patch 14 along an edge 32 of the patch 14. The edge 32 includes a notch 34 provided in the patch 14, the notch 34 having a depth $D_3$, here approximately 0.0305 wavelengths of the RF energy propagating therethrough, and a width $D_4$, here approximately 0.0611 wavelengths of the RF energy propagating therethrough. As described hereinabove, the patch 14 has a constant impedance along the width W of the patch, but a changing impedance along the length L of the patch 14. By connecting the end of the strip conductor 30 at the end of the depth of the notch 34, the impedance of the microstrip feed of the patch 14 is matched to the impedance of the strip conductor 30.

It should be appreciated that the patch 16 is connected to the patch 12 by strip conductor 30' along edge 26' and disposed having similar dimensions corresponding with patch 14 and strip conductor 30. Suffice it to say that patch 16 and strip conductor 30' are disposed as a mirror image to patch 14 and strip conductor 30. With the above described arrangement, patch 14 and patch 16 provide an image patch radiator element in front of the patch 12 for providing a desired end fire excitation. In a transmit mode, an RF signal is fed to the coaxial line 20 and coupled to the patch 12 wherein, acting as a resonant cavity, a portion of the RF signal is radiated from the patch 12. Another portion of the RF signal is coupled to the patch 14 by the strip conductor 30 wherein that portion of the RF signal is radiated from the patch 14. Still another portion of the RF signal is coupled to the patch 16 by the strip conductor 30' wherein that portion of the RF signal is radiated from the patch 16. By positioning the connection of the strip conductors 30, 30' as shown, nearly half of the RF signal is coupled from the patch 12 and split between the patch 14 and the patch 16. Alternatively, by changing the position of the connection of the strip conductors 30, 30', the impedance is changed which can be used to change the amount of RF energy fed to respective patches. It was observed that if the strip conductors 30, 30' are connected directly to respective patches and the length $\phi$ is minimized, then the beam of RF energy is directed in an aft direction. To provide the proper directivity, the length $\phi$ of strip conductors 30, 30' is appropriate to provide a $-90$ degrees phase lag on the forward patches 14, 16 relative to patch 12. The latter provides an image element in front of the patch 12 with an RF signal having equal amplitude and a $-90$ degree phase lag than that provided by the patch 12 which provides the desired end fire excitation. With the above described arrangement, the effects of mutual coupling caused by two patches in close proximity to each other are decreased as when a patch is located directly in front of the patch 12.

Figure 3A:
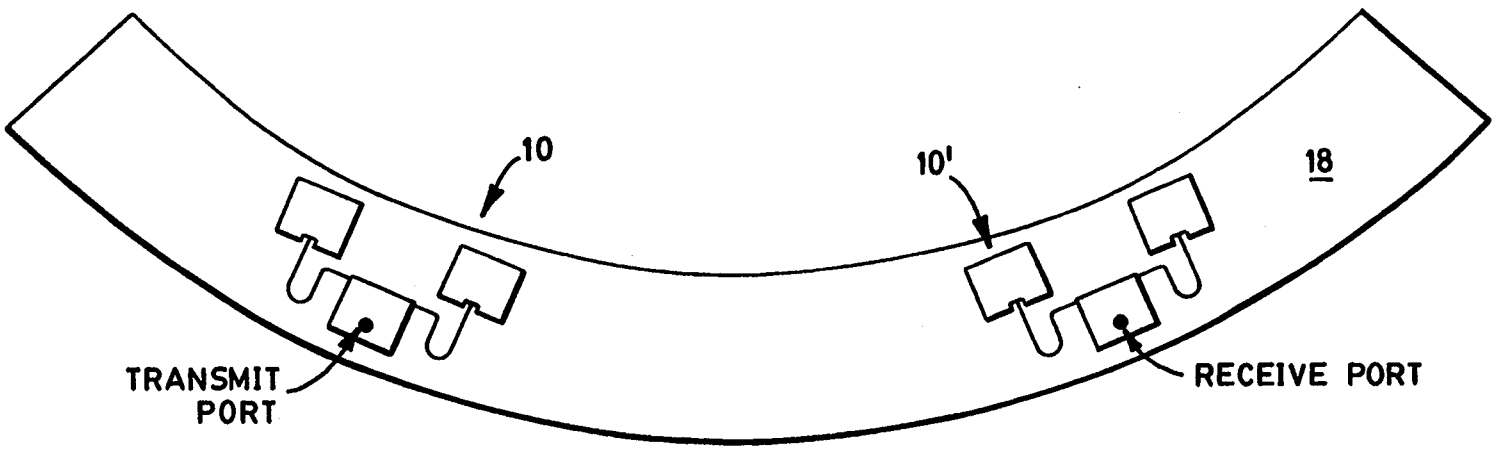
FIG. 3A is a plan view of a transmit and a receive patch radiator antenna according to the invention disposed on a common membrane.
Figure 4:
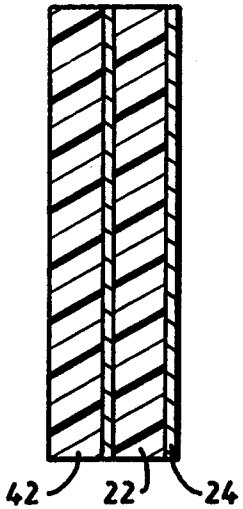
FIG. 4 is a cross-sectional view of the patch radiator antenna shown in FIG. 4 taken along the line 4A—4A.
Figure 3:
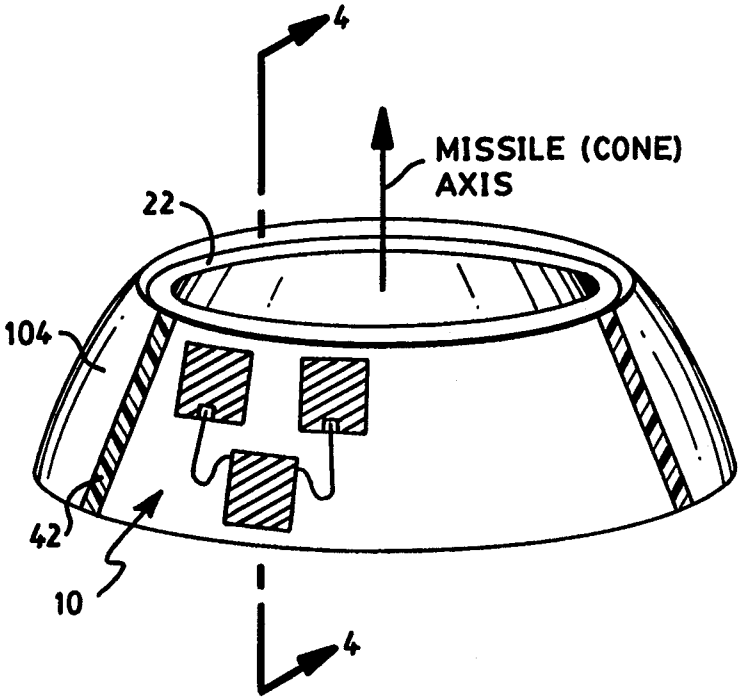
FIG. 3 is an isometric view of the patch radiator antenna disposed on a substrate partially torn away.

Referring now to FIG. 3, patch radiator antenna 10 is disposed on a missile cone and is protected by dielectric radome 42. Referring now to FIG. 4, a cross section is shown of the antenna assembly with dielectric radome 42 as the outer surface, the patch radiator antenna disposed on the surface of dielectric substrate 22, and the conductive sheet 24 forming the ground plane of the antenna assembly.

Figure 5B:
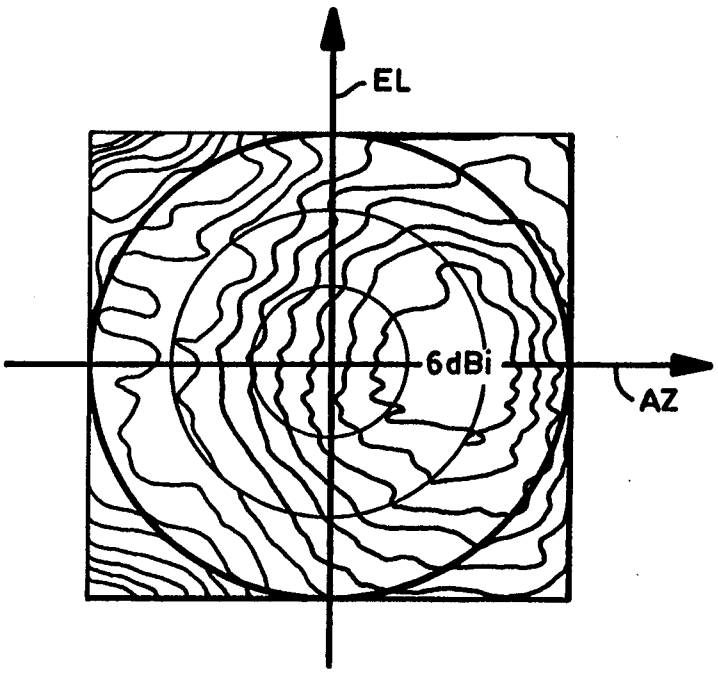
FIGS. 5A, 5B, and 5C are a sketch of relative signal strength about the axis of a missile provided by the patch radiator antennas, respectively, according to the invention.
Figure 5A:
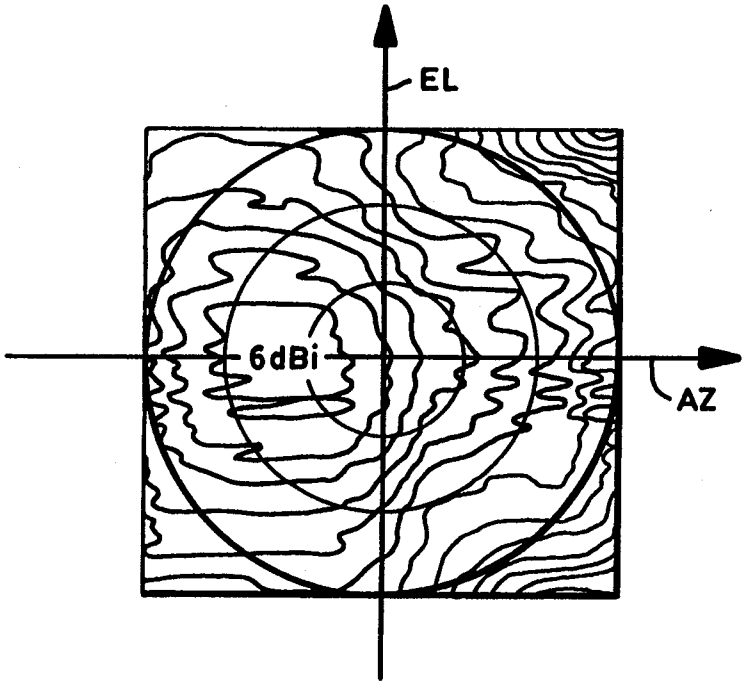
Figure 5C:
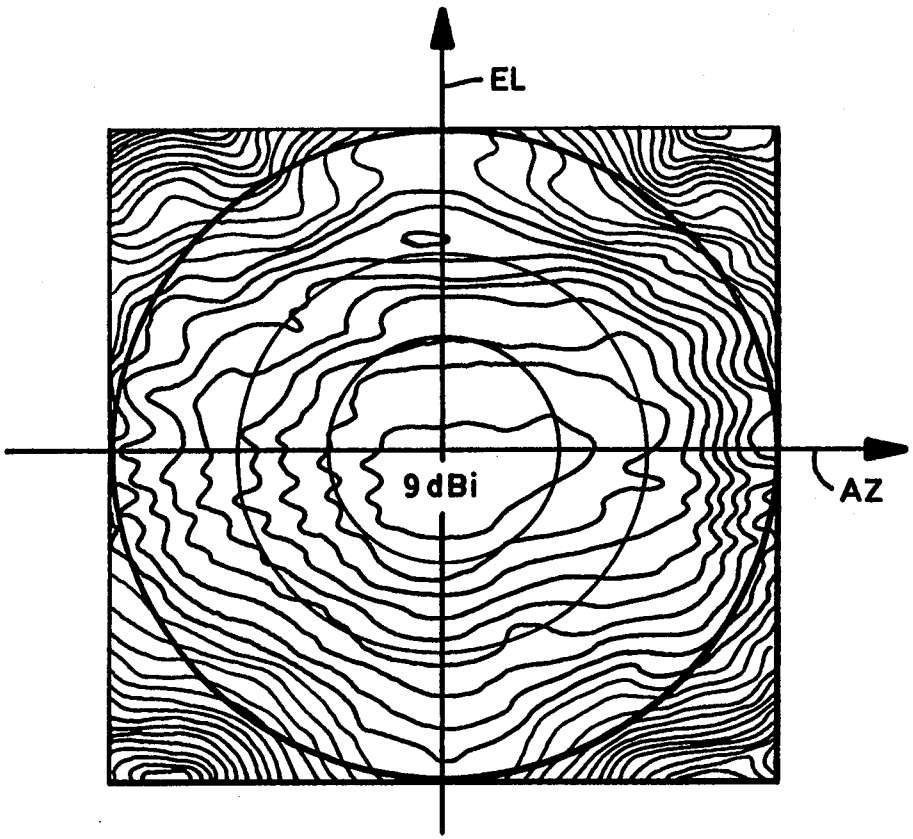

Referring now to FIGS. 5A, 5B and 5C, a measured pattern for the patch radiator antenna 10 is shown at the center frequency of the antenna in FIG. 5A and a measured pattern for the patch radiator antenna 10' is shown at the center frequency of the antenna in FIG. 5B. It should be appreciated the patterns as shown in FIGS. 5A, 5B and 5C are about the axis of the missile 100 (FIG. 1) along the elevation (EL) axis and the azimuth (AZ) axis as indicated. As shown, the patch radiator antenna 10 and the patch radiator antenna 10' provide a one way gain in a near end fire direction of 6 dBi. As shown in FIG. 5C, the combined patterns have a resultant two way on axis gain of greater than 9 dBi with broad symmetric coverage over a 45 degree cone angle. The VSWR is less than 1.7:1 over the desired bandwidth, here 200 MHz.

Variations to the patch radiator antenna 10 were investigated by differing parameter values than that as described above. Table I shows the varying parameter values and the difference from the nominal design. All other parameters remained the same as described above.

TABLE I

| Ckt | $\phi$, phase length | L, patch length | $D_1$, feed location | $S_1$, patch separation | Difference |
|---|---|---|---|---|---|
| 1 | 1.455 | 0.620 | 0.040 | 1.750 | Nominal Design |
| 2 | 1.375 | 0.615 | 0.040 | 1.750 | leas phase lag in forward patches |
| 3 | 1.535 | 0.620 | 0.040 | 1.750 | more phase lag in forward patches |
| 4 | 1.455 | 0.605 | 0.040 | 1.750 | shorter resonant patch |
| 5 | 1.455 | 0.635 | 0.040 | 1.750 | longer resonant patch |
| 6 | 1.455 | 0.620 | 0.040 | 1.750 | lower amplitude to forward patches |
| 7 | 1.455 | 0.620 | 0.040 | 1.750 | higher amplitude to forward patches |
| 8 | 1.455 | 0.620 | 0.040 | 1.500 | shorter forward patch separation |
| 9 | 1.535 | 0.620 | 0.040 | 1.750 | higher amplitude & more phase lag to forward patches |
| 10 | 1.535 | 0.620 | 0.040 | 1.500 | shorter patch separation & more phase lag to forward patches |

It was observed that only minor variation in the performance was obtained for the various iterations. However, antenna configuration (Ck) No. 2 demonstrated a larger tuning margin about the center frequency and thus may be desirable for applications requiring larger bandwidths. It was also observed that tuning frequency was primarily a function of patch radiator length and that cross-coupling isolation in all iterations is greater than 25 db between opposite array pairs.

Referring now to FIGS. 3, 3A and 4, the patch radiator antenna 10 is shown disposed on the truncated cone 104. The truncated cone 104 is shaped with an angle here of approximately 15 degrees and having a center coincident with the missile axis. The patch radiator antenna 10 is disposed between the dielectric substrate 22 and a dielectric substrate 42. The dielectric substrates 22, 42 is constructed from a Quartz/Cyanate Ester resin composite, provided by Omohundro Company of Costa Mesa, Calif. 92627. The patch radiator antennas 10, 10' are electro deposited using ½ oz. copper on the Quartz-/Cyanate Ester resin composite. Alternatively, to facilitate construction of the patch radiator antenna 10 and the patch radiator antenna 10', the patch radiator antennas 10 and 10' can be constructed on a common membrane 18 as shown in FIG. 3A. The membrane 18 can then be wrapped around the dielectric substrate 22 which in turn will properly disposed the patch radiator antenna 10 and 10' about the truncated ring 104. The dielectric substrate 22 is approximately 0.125 inches thick and a sheet 24 of conductive material is disposed upon an inner surface of the dielectric substrate 22 to provide a ground plane. The dielectric substrate 22 is provided as a thick substrate to provide the requisite bandwidth for the patch radiator antenna 10. The dielectric substrate 42 is disposed over the patch radiator antenna 10 and the patch radiator antenna 10' to protect the latter from the environment.

Having described this invention, it will now be apparent to one of skill in the art that the number and disposition of the patch radiator elements may be changed without affecting this invention. Furthermore, active phase shifters could be included between the probe fed patch radiator and the patch radiators fed by the probe fed patch radiator to actively control the phase of the signal to change the directivity of the antenna. It is felt, therefore, that this invention should not be restricted to its disclose embodiment, but rather should be limited only by the spirit and scope of the appended claims.

What is claimed is:

1. A patch radiator antenna comprising:

a sheet of conductive material;

a dielectric substrate having a first and second surface, the sheet of conductive material disposed upon the first surface of the dielectric substrate;

a plurality of patch radiator elements disposed upon the second surface of the dielectric substrate, each one of the plurality of patch radiator elements having sides with a width and a length, said plurality of patch radiator elements comprising:

a first patch radiator element comprising a feed probe to couple said first patch radiator element to an RF signal source;

at least one second patch radiator element comprising a microstrip feed along the width of the second patch radiator element, the at least one second patch radiator element disposed fore of the first patch radiator element which is disposed aft of the at least one second patch radiator element; and a third different patch radiator element comprising a microstrip feed along the width of the third different patch radiator element, the third different patch radiator element disposed fore of the first patch radiator element which is disposed aft of the third different patch radiator, the patch radiator antenna further comprising a first strip conductor having a first end and a second end, the first end connected to the microstrip feed of the third different patch radiator element and the second end connected along the length of the first patch radiator element; and a second strip conductor having a first end and a second end, the first end connected to the microstrip feed and the second end connected along the length of the first patch radiator element.

2. The patch radiator antenna as recited in claim 1 wherein the width of each one of the patch radiator elements is approximately 0.3174 wavelengths of a signal propagating therethrough and the length of each one of the patch radiator elements is approximately 0.2916 wavelengths of the signal propagating therethrough.

3. The patch radiator antenna as recited in claim 1 wherein the second patch radiator element having a center is disposed adjacent the third different patch radiator element having a center with a center to center spacing of approximately 0.8213 wavelengths of a signal propagating therethrough.

4. The patch radiator antenna as recited in claim 3 wherein the first patch radiator element having a center is disposed with the center of the first patch radiator element spaced approximately 0.3231 wavelengths of a signal propagating therethrough from a point centered between the centers of the second patch radiator element and the third patch radiator element.

5. The patch radiator antenna as recited in claim 1 wherein the at least one second patch radiator element further comprises a notch having a depth with an end and the microstrip feed is disposed at the end of the depth of the notch.

6. The patch radiator antenna as recited in claim 5 wherein the depth of the notch is approximately 0.0305 wavelengths of a signal propagating therethrough.

7. The patch radiator antenna as recited in claim 1 wherein the second end of the strip conductor is connected to the first patch radiator element having a corner at a distance approximately 0.0188 wavelengths of a signal propagating therethrough along the length from the corner.

8. The patch radiator antenna as recited in claim 1 further comprising a second different dielectric substrate having a surface disposed adjacent the plurality of patch radiator elements to protect the plurality of patch radiator elements from the environment.

9. A patch radiator antenna comprising:

a first patch radiator having a pair of length edges; and means for providing an image patch radiator element fore of the first patch radiator for providing a desired end fire excitation, said providing means comprising:

a second patch radiator having a microstrip feed, the second patch radiator disposed fore of the first patch radiator which is disposed aft of the second patch radiator;

a third patch radiator having a microstrip feed, the third patch radiator disposed fore of the first patch radiator which is disposed aft of the third patch radiator; and means for coupling a portion of RF energy propagating therethrough between the first patch radiator and the second patch radiator and between the first patch radiator and the third patch radiator, said coupling means comprising a first strip conductor having a first end and a second end, the first end connected to the first patch radiator along one of the length edges and the second end connected to the microstrip feed of the second patch radiator and a second strip conductor having a first end and a second end, the first end connected to the first patch radiator along a different one of the length edges and the second end connected to the microstrip feed of the third patch radiator.

10. The patch radiator antenna as recited in claim 9 further comprising:

a first and second dielectric substrate, each dielectric substrate having a first and second surface, the first patch radiator disposed between the second surface of the first dielectric substrate and the first surface of the second dielectric substrate; and a sheet of conductive material disposed on the first surface of the first dielectric substrate.

11. The patch radiator antenna as recited in claim 9 wherein the patch radiators, each having a width and a length, are disposed with the width of each one of the patch radiators is approximately 0.3174 wavelengths of a signal propagating therethrough and the length of each one of the patch radiators is approximately 0.2916 wavelengths of the signal propagating therethrough.

12. The patch radiator antenna as recited in claim 9 wherein the second and the third patch radiator further comprises a notch having a depth with an end and the microstrip feed is disposed at the end of the depth of the notch.

13. The patch radiator antenna as recited in claim 12 wherein the depth of the notch is approximately 0.0305 wavelengths of a signal propagating therethrough.

14. A method of providing a patch radiator antenna comprising the steps of:

providing a dielectric substrate having a first and second surface with a conductive material disposed on the first surface;

disposing a plurality of patch radiator elements on the second surface of the dielectric substrate, each one of the plurality of patch radiator elements having a width and a length; and connecting a first patch radiator element to a second and a third different patch radiator element with a respective first and second strip conductor having a first end and a second end, said second and third different patch radiator element disposed fore of the first patch radiator element, the first end of the first strip conductor connected along the width of the second patch radiator element and the second end of the first strip conductor connected along the length of the first patch radiator and the first end of the second strip conductor connected along the width of the third patch radiator element and the second end of the second strip conductor connected along an opposing length of the first patch radiator.

15. The method as recited in claim 14 further comprising the steps of:

providing a coaxial probe feed to the first patch radiator element to provide a feed for the patch radiator antenna.

16. The method as recited in claim 14 further comprising the steps of:

providing a second dielectric substrate having a first and second surface with the plurality of patch radiator elements disposed adjacent the first surface, said second dielectric substrate surrounding said first dielectric substrate.

* * * * *